United States Patent [19]

Draper, Jr.

[11] 4,184,970

[45] Jan. 22, 1980

[54] ANTISTATIC, FABRIC-SOFTENING DETERGENT ADDITIVE

[75] Inventor: Ellsworth R. Draper, Jr., Cincinnati, Ohio

[73] Assignee: The Procter & Gamble Company, Cincinnati, Ohio

[21] Appl. No.: 961,447

[22] Filed: Nov. 16, 1978

[51] Int. Cl.[2] ..... D06M 13/34

[52] U.S. Cl. ..... 252/8.8; 252/8.6

[58] Field of Search ..... 252/8.6, 8.8, 8.9; 264/117

[56] References Cited

U.S. PATENT DOCUMENTS

| | | | |
|---|---|---|---|
| 3,664,961 | 5/1972 | Norris | 264/117 |
| 3,936,537 | 2/1976 | Baskerville et al. | 252/8.8 |
| 3,950,275 | 4/1976 | Toyoda et al. | 264/117 |
| 3,966,629 | 6/1976 | Dumbrell | 252/8.8 |
| 4,141,841 | 2/1979 | McDanald | 252/8.8 |

*Primary Examiner*—William E. Schulz

*Attorney, Agent, or Firm*—Robert B. Aylor; Richard C. Witte; Thomas H. O'Flaherty

[57] ABSTRACT

Detergent-compatible antistatic compositions are described comprising stable agglomerates of water-soluble neutral or alkaline salts, prills of quaternary ammonium compounds intimately mixed with organic dispersion inhibitors, and water, and being substantially free of conventional organic agglomerating agents. These compositions provide static control benefits in laundering operations at reduced antistatic agent levels.

37 Claims, No Drawings

ANTISTATIC, FABRIC-SOFTENING DETERGENT ADDITIVE

TECHNICAL FIELD

This invention relates to compositions which provide static control benefits in fabric laundering operations. More particularly, it relates to providing these benefits at reduced agent levels while simultaneously cleansing fabrics by means of conventional detergent compositions and detergency builders.

BACKGROUND ART

Various quaternary ammonium compounds are known in the art to possess antistatic properties. These quaternary ammonium compounds are also known to be generally incompatible with anionic surfactants commonly employed in laundering compositions. The anionic surfactants attack and inactivate the quaternary ammonium compounds in the wash-water environment. Thus, larger amounts than desired of the fairly expensive quaternary ammonium compounds must be added to detergent compositions in order to avoid total inactivation in wash solution. It therefore would be highly beneficial, from a performance and economic standpoint, to be able to shield the quaternary ammonium compounds in the wash water, without disturbing their effectiveness as static control agents in the subsequent machine drying process.

Techniques known in the art for preserving the antistatic properties of the quaternary ammonium compounds, such as the prilling of the quaternary ammonium compound with organic dispersion inhibitors, as disclosed in U.S. Pat. No. 3,936,537, issued to Baskerville et al on Feb. 3, 1976, incorporated herein by reference, and the agglomeration of that prill with certain water-soluble neutral or alkaline salts, using organic agglomerating agents, as disclosed in the copending application of McDanald, Ser. No. 816,761, filed on July 18, 1977, now U.S. Pat. Ser. No. 4,141,841, issued Feb. 27, 1979 incorporated herein by reference, while delivering improved static control and softening benefits over methods then known in the art, were only partially effective. Some of the quaternary ammonium compound continued to be inactivated by the anionic surfactants, and some of the prills continued to be broken up and dispersed in the wash water, preventing the efficient desposition of antistatic materials of an effective size range onto the fabrics to be treated. The above-described techniques still required the addition of larger quantities of the quaternary ammonium compound than necessary to achieve good static control in the absence of the detergent. Also, the conventional organic agglomerating agents, such as dextrin glue solutions, required in McDanald to agglomerate the prills with the salts could cause poor caking characteristics and flowability problems in the detergent product, making handling and packaging difficult at times.

The present invention, by contrast, teaches the deliberate, pre-wash-water complexing of certain anionic components with the quaternary ammonium compounds to deliver superior static control and softening benefits at significantly reduced levels of antistatic material. The Baskerville and McDanald references attempted to avoid the interaction of anionic components with the quaternary ammonium compound upon which the present invention is based. Further, it has been discovered that water can act as the agglomerating agent and/or the complexing medium, while producing a product with at least equivalent caking charcteristics, and even superior caking qualities under certain conditions. Thus, the organic agglomerating agents required in McDanald have been eliminated in the present invention, reducing material costs and eliminating extra processing and handling steps.

It is, therefore, an object of the present invention to provide a particulate additive for laundry detergent compositions to reduce the tendency of fabrics washed with such detergent compositons to generate or retain static electricity when subjected to a subsequent machine drying process.

It is also an object of the present invention to provide a detergent composition capable of concurrently laundering, softening, and imparting static control benefits to fabrics washed therewith and subsequently machine dried.

It is another object of the present invention to provide a particulate antistatic fabric-softening additive which can be included in a conventional detergent composition and which will retain its effectiveness in softening fabrics laundered therewith in a subsequent machine drying process.

It is a further object of the present invention to provide for antistatic fabric-softening effectiveness by using a minimum amount of antistatic fabric-softening agent in a detergent composition.

It is another object of the present invention to provide an antistatic, fabric-softening detergent additive which will remain relatively homogeneously admixed in a conventional detergent composition.

It is an even further object of the present invention to provide a detergent composition with good caking and flowability characteristics.

SUMMARY OF THE INVENTION

The present invention encompasses a particulate detergent additive for preventing static buildup on textiles and softening fabrics when applied thereto from a laundry solution, said particulate additive being substantially free of organic agglomerating agents, consisting essentially of an agglomerate of:

(a) from about 5% to about 75% by weight of a water-soluble neutral or alkaline salt, (b) from about 5% to about 75% by weight of an intimate mixture of (i) from about 99.9% to about 20% by weight of a quaternary ammonium compound of formula $[R_1R_2R_3R_4N]^+Y^-$ wherein at least one but not more than two of $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y constituting an anionic radical selected from the group consisting of hydroxide, halide, sulfate, methylsulfate, ethylsulfate and phosphate ions, and (ii) from about 0.1% to about 80% by weight of a dispersion inhibitor, being a solid organic material having a solubility in water of 50 ppm maximum at 25° C. and a softening point in the range of 75° F. to 250° F., said material being selected from the group consisting of paraffinic waxes, cyclic and acyclic mono- and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof, and (c) from about 5% to about 75% by weight of water, substantially all of the additive particles having a size of about 10μ to about 500μ, a solubility in water of about 50 ppm maximum at 25° C., and a softening point of from about 75° F. to about 250° F.

The present invention also encompasses a detergent composition for preventing static buildup on textiles and softening fabrics laundered therewith, comprising:

(1) from about 5% to about 83% by weight of surfactant selected from the group consisting of anionic, nonionic, ampholytic, and zwitterionic surfactants, and mixtures thereof.

(2) from about 5% to about 85% by weight of detergency builder, (3) from about 10% to about 50% by weight of a particulate detergent additive being substantially free of organic agglomerating agents, consisting essentially of an agglomerate of:

(a) from about 5% to about 75% by weight of a water-soluble neutral or alkaline salt, (b) from about 5% to about 75% by weight of particles being an intimate mixture of (i) from about 99.9% to about 0.1% by weight of a quaternary ammonium compound of formula $[R_1R_2R_3R_4N]^+Y^-$ wherein at least one but not more than two of $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y constituting an anionic radical selected from the group consisting of hydroxide, halide, sulfate methylsulfate, ethylsulfate and phosphate ions, and (ii) from about 0.1% to about 80% by weight of a dispersion inhibitor, being a solid organic material having a solubility in water of 50 ppm maximum at 25° C. and a softening point in the range of 75° F. to 250° F., said material being selected from the group consisting of paraffinic waxes, cyclic and acyclic mono- and polyhydric alcohols, substituted and unsubstituted aliphatic carboxylic acids, esters of the foregoig alcohol and acids, $C_3$–$C_4$ alkylene oxide condensates of any of the foregoing materials and mixtures thereof, and (c) from about 5% to about 75% by weight of water, substantially all of the additive particles having a size of about 10μ to about 500μ, a solubility in water of about 50 ppm maximum at 25° C., and a softening point of from about 75° F. to about 250° F.

DISCLOSURE OF THE INVENTION

This invention comprises the deliberate, pre-wash-water complexing of quaternary ammonium compounds with certain anionic complexing components to deliver superior static control and softening benefits at significantly reduced levels of antistatic material. The reaction of the cationic quaternary ammonium compound with the anionic species results in the formation of a relatively insoluble complex which at least partially constitutes the surfaces of the antistatic material particles. The insoluble complex constitutes at least 10% of said surfaces, preferably constitutes at least 25% of said surfaces, more preferably constitutes at least 50% of said surfaces, and most preferably, the reaction produces an insoluble complex constituting substantially all the surfaces of the antistatic material particles. The reaction can also result in the complexation of substantially all of the quaternary ammonium compound. It is believed that the formation of the insoluble complex delivers static control advantages because it separates unreacted antistatic material from the wash-water environment and thus hinders the inactivation of this antistatic material; it reduces breakup of the quaternary ammonium particles or prills in the wash-water, thereby allowing for a more efficient deposition of antistatic material of an effective size range onto the laundered fabrics; and it delivers some additional static control of its own to the system. Since the insolubility of the complex formed is important in the present invention, the anionic complexing component should be chosen, in view of the particular cationic antistatic agent used, to achieve an insoluble complex. The complexing components should also be chosen to maximize the antistatic properties of the complex itself. Particulate additives comprising the quaternary ammonium static control agents complexed with these anionic materials are described in concurrently filed U.S. Pat. application Ser. No. 961,446, Jones, incorporated herein by reference, and in concurrently filed U.S. Pat. application Ser. No. 961,445, Draper and Jones, incorporated herein by reference, which describes the quaternary ammonium compounds intimately mixed with organic dispersion inhibitors prior to the complexing reaction.

In a particularly preferred embodiment of the present invention, the particulate detergent additive additionally contains an organic dispersion inhibitor which is intimately mixed with the quaternary ammonium compound and formed into a prill prior to the complexing reaction. The dispersion ihibitor adds to the insolubility and physical integrity of the complex formed and thus enhances the antistatic benefits realized.

As another preferred embodiment of the present invention, a mixture of anionic complexing components is used. Especially preferred are mixtures of sodium tripolyphosphate with the other complexing components described herein. Such a mixture, with several possible participating complexing components, can assist in the formation of the insoluble complex. Multi-component and/or multi-phase complexes, having greater insolubility and/or antistatic properties, can be formed. Further, certain anionic complexing components, such as water-soluble neutral or alkaline salts, especially STP, can absorb excess moisture, making the particulate detergent additive stronger and more free-flowing.

The additive products of the present invention can be admixed or agglomerated with smectite clays to enhance fabric softening, and the detergent composition of this invention can additionally contain water-soluble detergency compounds and detergency builder salts. The quaternary ammonium compound provides antistatic benefits on the fabrics and also adds an increment of softening benefit to the fabrics, while the detergent surfactant and builder components provide known cleansing and building benefits.

The individual particle size of the particulate detergent additive lies in the range from about 10μ to 500μ, preferably from about 25μ to about 250μ, and most preferably from about 50μ to about 100μ. Further, the particulate additive should not have a solubility in water at 25° C. of greater than 50 ppm (parts per million), preferably less than 10 ppm. The softening or melting point of the particulate additive should lie in the range from about 75° F. to about 250° F., preferably from about 100° F. to about 200° F., more preferably from about 150° F. to about 175° F. The above specified ranges need not apply to complexed quaternary ammonium compound particles free of the organic dispersion inhibitor, although the ranges preferably also apply in this situation. Individual particles of the particulate detergent additive can become agglomerated during processing steps. These agglomerates have a size of from about 10μ to about 2000μ. The agglomerates break-up in the wash water, but the individual particles remain relatively insoluble in the water.

Anionic Complexing Component

The anionic complexing component required to form the insoluble complex is selected from the group consisting of nonsurfactant electrolytes, anionic synthetic surfactants, soaps, and mixtures thereof. The anionic component represents from about 0.01% to about 80% by weight, preferably from about 1% to about 70% by weight, and most preferably from about 10% to about 60% by weight of the particulate detergent additive. The anionic component is preferably reacted with the static control agent or static control agent/dispersion inhibitor mixture as a solution (preferably a water solution) which comprises from about 1% to about 80% by weight, preferably from about 5% to about 50% by weight of the anionic component. Preferably, the anionic complexing component is present in solution at a concentration close to its saturation point. The anionic complexing solution is preferably sprayed onto the quaternary ammonium compound itself, or onto prills, agglomerates or admixes containing it. A fluidized bed reactor can also be used to contact the anionic solution with the quaternary compound particles or prills. The anionic complexing component can optionally be admixed as a solid with the quaternary ammonium compound before being complexed, preferably by being sprayed with a complexing medium, such as water or an aqueous complexing solution.

Nonsurfactant electrolytes suitable as the anionic complexing component include multivalent inorganic or organic electrolytes, such as: alkali metal carbonates, alkali metal tetraborates, alkali orthophosphates, alkali metal polyphosphates, alkali metal bicarbonates, alkali metal silicates, alkali metal sulfates, alkali metal citrates, alkali metal acetates, and mixtures thereof. Preferred are sodium tetraborate, potassium tetraborate, sodium bicarbonate, potassium bicarbonate, sodium carbonate, potassium carbonate, sdium tripolyphosphate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, sodium acetate, potassium acetate, and mixtures thereof. Especially preferred are sodium tripolyphosphate, sodium citrate, sodium sulfate, and mixtures thereof.

Water-soluble salts of the higher fatty acids, i.e. "soaps", are useful as the anionic complexing component herein. Suitable are ordinary alkali metal soaps such as the sodium, potassium, ammonium, and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Anionic synthetic surfactants useful as a complexing component herein include water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present invention are the sodium and potassium alkyl sulfates, especially those obtained by sulfating the higher alcohols ($C_8$–$C_{18}$ carbon atoms) produced by reducing the glycerides of tallow or coconut oil; sodium or potassium $C_8$–$C_{20}$ paraffin sulfonates; and sodium and potassium alkyl benzene sulfonates, in which the alkyl group contains from about 9 to about 15 carbon atoms in straight chain or branched chain configuration, e.g., those of the type described in U.S. Pat. No. 2,220,099 and 2,477,383, incorporated herein by reference (especially valuable are linear straight chain alkyl benzene sulfonates in which the average of the alkyl groups is about 11.8 carbon atoms and commonly abbreviated as $C_{11.8}$ LAS).

Other useful anionic surfactants for use herein are alkyl ethoxy sulfates. These materials have the formula $RO(C_2H_4O)_xSO_3M$ wherein R is alkyl or alkenyl of about 10 to about 20 carbon atoms, x is 1 to 30, and M is a water-soluble cation such as alkali metal, ammonium, and substituted ammonium. The alkyl ethoxy sulfates useful in the present invention are condensation products of ethylene oxide and monohydric alcohols having about 10 to about 20 carbon atoms. Preferably, R has 14 to 18 carbon atoms. The alcohols can be derived from fats, e.g., coconut oil or tallow, or can be synthetic. Lauryl alcohol and straight chain alcohols derived from tallow are preferred herein. Such alcohols are reacted with 1 to 30, and especially 1 to 6, molar proportions of ethylene oxide and the resulting mixture of molecular species, having, for example, an average of 3 moles of ethylene oxide per mole of alcohol, is sulfated and neutralized.

Specific examples of fat-derived alkyl ethoxy sulfates of the present invention are sodium coconut alkyl ethylene glycol ether sulfate; sodium tallow alkyl trioxyethylene ether sulfate; and sodium tallow alkyl hexaoxyethylene ether sulfate.

Examples of alkyl ethoxy sulfates of synthetic origin in which the starting alcohol is a narrow-cut olefin feed stock include sodium $C_{14-15}$ alkyl trioxyethylene ether sulfate and $C_{15-16}$ alkyl trioxyethylene ether sulfate.

Other anionic surfactant compounds useful herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain from about 8 to about 13 carbon atoms.

Other useful anionic surfactants herein include the water-soluble salts of esters of alpha-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkene sulfonates containing from about 10 to 20 carbon atoms in the alkane group; and beta-alkyloxy alkane sulfonates containing from about 1 to 3 carbon atoms in the alkyl group and from about 8 to 20 carbon atoms in the alkane moiety.

Other useful anionic surfactants utilizable herein are olefin sulfonates having about 12 to about 24 carbon atoms. The term "olefin sulfonates" is used herein to means compounds which can be produced by the sulfonation of alpha-olefins by means of uncomplexed sulfur trioxide, followed by neutralization of the acid reaction mixture in conditions such that any sulfones which have been formed in the reaction are hydrolyzed to give the corresponding hydroxyalane sulfonates. The sulfur trioxide can be liquid or gaseous, and is usually, but not necessarily, diluted by inert diluents for example by liquid $SO_2$, chlorinated hydrocarbons, etc., when used in the liquid form, or by air, nitrogen, gaseous $SO_2$, etc., when used in the gaseous form.

The alpha-olefins from which the olefin sulfonates are derived are mono-olefins having 12 to 24 carbon atoms, preferably 14 to 16 carbon atoms. Preferably they are straight chain olefins. Examples of suitable 1-olefins include 1-dodecene, 1-tetradecene, 1-hexadecene, 1-octadecene, 1-eicosene, and 1-tetracosene.

In addition to the true alkene sulfonates and a portion of hydroxyalkane sulfonates, the olefin sulfonates can contain minor amount of other materials, such as alkene disulfonates depending upon the reaction conditions, proportion of reactants, the nature of the starting olefins and impurities in the olefin stock and side reactions during the sulfonation process.

Preferred anionic synthetic surfactants are alkali and alkaline earth metal, ammonium and alkanol ammonium salts of linear and branched $C_{10}$–$C_{14}$ alkyl benzene sulfonates, $C_{10}$–$C_{20}$ alpha-sulfo carboxylic acid salts and esters in which the alkyl group has 1–8 carbon atoms, $C_{10}$–$C_{20}$ alkane sulfonates, $C_{14}$–$C_{18}$ olefin sulfonates, $C_{10}$–$C_{18}$ alkyl sulfates and condensation products thereof with 1–20 moles of ethylene oxide; and mixtures thereof.

QUATERNARY AMMONIUM ANTISTATIC AGENT

The cationic component of the insoluble complex is a quaternary ammonium antistatic agent, which will be employed in the particulate detergent additive in an amount from about 5% to about 7% by weight, preferably from about 10% to about 60% by weight, and most preferably from about 30% to about 50% by weight. Suitable quaternary ammonium antistatic agents are included in U.S. Pat. No. 3,936,537, Baskerville et al, which has been incorporated hereinabove by reference. In the preferred embodiment of the present invention where the quaternary ammonium compound is intimately mixed with an organic dispersion inhibitor and formed into a prill prior to the complexing reaction, the quaternary ammonium antistatic agent will normally be employed at a level of 99.9% to about 20% by weight, preferably from about 90% to about 20% by weight, more preferably from about 80% to about 50% by weight, and most preferably from about 75% to about 50% by weight of the intimate mixture.

The antistatic agents useful herein are quaternary ammonium salts of the formula $[R_1R_2R_3R_4N]^+Y^-$ *wherein* $R_1$ and preferably $R_2$ represent an organic radical containing a group selected from a $C_{16}$–$C_{22}$ aliphatic radical or an alkyl phenyl or alkyl benzyl radical having 10–16 atoms in the alkyl chain, $R_3$ and $R_4$ represent hydrocarbyl groups containing from 1 to about 4 carbon atoms, or $C_2$–$C_4$ hydroxy alkyl groups and cyclic structures in which nitrogen atom forms part of the ring, and Y is an anion such as halide, methylsulfate, or ethylsulfate.

In the context of the above definition, the hydrophobic moiety (i.e., the $C_{16}$–$C_{22}$ aliphatic, $C_{10}$–$C_{16}$ alkyl phenyl or alkyl benzyl radical) in the organic radical $R_1$ may be directly attached to the quaternary nitrogen atom or may be indirectly attached thereto through an amide, ester, alkoxy, ether, or like grouping.

The quaternary ammonium antistatic agents used in this invention can be prepared in various ways well known in the art. Many such materials are commercially available. The quaternaries are often made from alkyl halide mixtures corresponding to the mixed alkyl chain lengths in fatty acids. For example, the "ditallow" quaternaries are made from alkyl halides having mixed $C_{14}C_{18}$ chain lengths. Such mixed di-long chain quaternaries are useful herein and are preferred from a cost standpoint. As used herein "ditallow" is intended to refer to the above-described ditallowalkyl quaternaries.

The quaternary ammonium antistatic compounds useful herein include both water-soluble and substantially water-insoluble materials. Imidazolinium compounds enumerated in the Baskerville patent possess appreciable water solubility and can be utilized in the present invention by mixing with the appropriate type and level of organic dispersion inhibitor and complexing component to give ultimate particle solubility in water of less than 50 ppm (parts per million) at 25° C. Relatively water-soluble quaternary ammonium antistatic agents may also be of the nonring variety, such as diisosteryl dimethyl ammonium chlorides disclosed in U.S. Pat. No. 3,395,100 to Fisher et al, incorporated herein by reference. Exemplary quaternary ammonium imidazolinium compounds are specifically methyl-1-alkylamidoethyl-2-alkyl imidazolinium methyl sulfates, specifically 1-methyl-1-[(tallowamido)ethyl]-2-tallowimidazolinium methyl sulfate. However, the most useful quaternary ammonium antistatic agents are characterized by relatively limited solubility in water.

The following are representative examples of substantially waer-insoluble quaternary ammonium antistatic agents suitble for use in the compositions of the instant invention. All of the quaternary ammonium compounds listed can be formulated with the detergent compositions herein, but the compilation of suitable quaternary compounds hereinafter is only by way of example and is not intended to be limiting of such compounds. Dioctadecyldimethyl ammonium chloride is an especially preferred quaternary antistatic agent for use herein by virtue of its high antistatic activity; ditallow dimethyl ammonium chloride is equally preferred because of its ready availability and its good antistatic activity; other useful di-long chain quaternary compounds are dicetyl dimethyl ammonium chloride; bisdocosyl dimethyl ammonium chloride; didodecyl dimethyl ammonium chloride; ditallow dimethyl ammonium bromide; dioleoyl dimethyl ammonium hydroxide, ditallow dimethyl ammonium chloride; ditallow dipropyl ammonium bromide; ditallow dibutyl ammonium fluoride; cetyldecylmethylethyl ammonium chloride; bis-[ditallow dimethyl ammonium] sulfate; tris-[ditallow dimethyl ammonium] phosphate; and the like.

The preceding description of quaternary ammonium antistatic compounds is an abbreviated discussion. Description in further detail is contained in U.S. Pat. No. 3,936,537, Baskerville et al, incorporated hereinabove by reference.

Organic Dispersion Inhibitor

As a preferred embodiment of the present invention, the particulate detergent additive contains an organic dispersion inhibitor which is intimately mixed with the quaternary ammonium compound in the form of a prill prior to the complexing reaction. The organic dispersion inhibitor adds to the insolubility and physical integrity of the complex formed and thus enhances the antistatic benefits realized. The organic dispersion inhibitor represents from about 0.1% to about 80% by weight, preferably from about 10% to about 80% by weight, more preferably from about 20% to about 50% by weight, and most preferably from about 25% to about 50% by weight of the intimate mixture. The intimate mixture represents from about 5% to about 75%, preferably from about 10% to about 60%, most preferably from about 30% to about 50% by weight of the particulate detergent additive. The dispersion inhibitor should have a solubility in water of 50 ppm maximum at 25° C. and a softening point in the range of 100°-200° F., preferably 125°-200° F., and is preferably selected from the group consisting of paraffinic waxes, cyclic and acyclic mono- and polyhydric alcohols, substituted and unsubstituted aliphatic carboxylic acids, esters of the foregoing alcohols and acids, $C_3$-$C_4$ alkylene oxide condensates of any of the foregoing materials and mixtures thereof.

Tallow alcohol is preferred because of ready availablity, but useful dispersion inhibitors include other fatty alcohols in the $C_{14}$-$C_{26}$ range, such as myristyl alcohol, cetyl alcohol, stearyl alcohol, arachidyl alcohol, behenyl alcohol, and mixtures thereof. Saturated fatty acids having 12 to 24 carbon atoms in the alkyl chain can be used, such as: lauric acid, myristic acid, palmitic acid, stearic acid, arachidic acid, and behenic acid, as well as mixtures of these, particularly those derived from naturally occurring sources such as tallow, coconut, and marine oils. Esters of the aliphatic alcohols and fatty acids are useful dispersion inhibitors, provided they have a total of more than 22 carbon atoms in the acid and alkyl radicals. Long chain $C_{22}$-$C_{30}$ paraffinic hydrocarbon materials such as the saturated hydrocarbon octacosane having 28 carbon atoms can also be used. When fatty acids are used as dispersion inhibitors as hereinabove described, the anionic complexing component may not include soaps, which are more fully descibed on page 9.

Another preferred class of materials useful in the present invention are the water-insoluble sorbitan esters which comprise the reaction product of $C_{12}$-$C_{26}$ fatty acyl halides or fatty acids and the complex mixtures of cyclic anhydrides of sorbitol collectively known as "sorbitan". The reaction sequence necessary to produce such sorbitan esters from sorbitol is set out in the Baskerville patent incorporated by reference. The sorbitan esters are, in turn, complex mixtures of mono, di-, tri-, and tetra-ester forms, of which the tri- and tetra- are the least water-soluble and hence the most preferred for the purposes of the present invention. Typical fatty acids that are suitable for the alkyl portion of the ester are palmitic, stearic, docosanoic, and behenic acids and mixtures of any of these. These sorbitan esters, particularly the tri- and tetra- esters, provide a degree of fabric softening in addition to their function as dispersion inhibitors.

The previous discussion of organic dispersion inhibitors is an abbreviated one. Further discussion in detail is set out in U.S. Pat. No. 3,936,537, Baskerville et al, incorporated hereinabove by reference.

Water-Soluble, Neutral or Alkaline Salt

As another preferred embodiment of the present invention, mixtures of anionic complexing components are used in forming the particulate detergent additives. These mixtures can be formed into a solution and sprayed onto the quaternary ammonium compound forming the desired complex, or, one of the complexing components, preferably a water-soluble neutral or alkaline salt, is added to the system as a solid prior to complexing with a solution of the remaining complexing component. The salt can assist in the formation of the insoluble complex, thus enhancing the benefits realized from its formation, and it can itself complex with the quaternary ammonium compound. Multi-component and/or multi-phase complexes, having greater insolubility and/or anti-static properties, can be formed by the complexing componetns and the salt. Further, the salt can absorb excess moisture, making the particulate detergent additive stronger and more free-flowing. A neutral or alkaline salt has a pH in solution of seven or greater. This salt can be either organic or inorganic. The water-soluble, neutral or alkaline salt will be employed in the particulate detergent additive in an amount from about 5% to about 75% by weight, preferably from about 5% to about 40% by weight, more preferably from about 10% to about 30% by weight, most preferably from about 10% to about 20% by weight of the particulate detergent additive.

In another embodiment, the dispersion inhibitor/-static control agent intimate mixture is admixed with the water-soluble neutral or alkaline salts described herein and this mixture is sprayed with water. The resulting product, which is free of conventional agglomerating agents (such as dextrin glues), is a very effective static control product, providing performance, cost and physical property benefits over similar agglomerates which utilize conventional agglomerating agents.

Examples of such water-soluble neutral or alkaline salts include alkali metal chlorides such as sodium chloride and potassium chloride, alkali metal fluorides such as sodium fluoride and potassium fluoride, alkali metal carbonates such as sodium carbonates, alkali metal silicates, and mixtures thereof. Any conventional water-soluble, neutral or alkaline inorganic salts such as the alkali metal sulfates, notably sodium sulfate, can be employed in the present invention.

Water-soluble, neutral or alkaline salts also include the variety commonly known as detergency builder salts, especially alkaline, polyvalent anionic builder salts. Suitable detergency builder salts include polyvlent inorganic or organic salts or mixtures thereof. Suitable water-soluble, preferred inorganic alkaline detergency builder salts include alkali metal carbonates, borates, phosphates, polyphosphates, bicarbonates, silicates, and sulfates. Specific examples of such salts include the sodium and potassium tetraborates, perborates, bicarbonates, carbonates, tripolyphosphates, pyrophosphates, orthophosphates and hexametaphosphates.

Examples of suitable organic alkaline detergency builder salts are: water-soluble aminopolyacetates, e.g., sodium and potassium ethylenediaminetetraacetates, nitrilotriacetates and N-(2-hydroxyethyl)nitrilodiacetates; water-soluble salts of phytic acid, e.g., sodium and potassium phytates; water-soluble polyphosphonates, including sodium, potassium and lithium salts of ethane-1-hydroxy-1,1-diphosphonic acid; sodium, potassium and lithium salts of methylene diphosphonic acid and comparable examples.

Additional organic builder salts are disclosed in Ser. No. 764,126, Rodney M. Wise, et al, filed Jan. 31, 1977, now U.S. Pat. Ser. No. 4,083,813, issued Apr. 11, 1978, entitled "Process for making Detergent Compositions", incorporated herein by reference, in U.S. Pat. No. 3,308,067, issued to F. L. Diehl on Mar. 7, 1967, incorporated herein by reference, and in U.S. Pat. No. 2,264,103, issued to N. B. Tucker on November 25, 1941, incorporated herein by reference. The Tucker patent particularly disclosed polycarboxylate and citrate salts, notably sodium citrate which may be used in the present invention as a water-soluble, alkaline salt. Further detergency builder salts are disclosed in U.S. Pat. No. 3,936,537, Baskerville et al, incorporated hereinabove by reference.

Optional Clay Ingredient

The particulate detergent additive may optionally contain smectite clay as an ingredient. These smectite clays may be admixed with the particulate detergent additive of this invention at levels from about 5% to about 70% by weight, preferably from about 20% to about 60% by weight, and most preferably from about 25% to about 50% by weight of the resulting admixture, to form compositions which provide laundered fabrices with outstanding fabric softening and static control benefits. The clays used herein are "impalpable", i.e., have a particle size which cannot be perceived tactilely. Impalpable clays have particle sizes below about 50 microns; the clays used herein have a particle size range of from 5 microns to about 50 microns.

The clay minerals can be described as expandable, three-layer clays, i.e. aluminosilicates and magnesium silicates, having an ion exchange capacity of at least 50 meq/100 g. of clay and preferably at least 60 meq/100 g. of clay. The term "expandable" as used to describe clays relates to the ability of the layered clay structure to be swollen, or expanded, on contact with water. The three-layer expandable clays used herein are those materials classified geologically as smectites.

There are two distinct classes of smectite clays that can be broadly differentiated on the basis of the numbers of octahedral metal-oxygen arrangements in the central layer for a given number of silicon-oxygen atoms in the outer layers.

The clays employed in the compositions of the instant invention contain cationic counterions such as protons, sodium ions, potassium ions, calcium ions, and lithium ions. It is customary to distinguish between clays on the basis of one cation predominantly or exclusively absorbed. For example, sodium clay is one in which the absorbed cation is predominantly sodium. Such absorbed cations can become involved in exchange reactions with cations present in aqueous solutions. A typical exchange reaction involving a smectite-type clay is expressed by the following equation: smectite clay $(Na)^+ + NH_4OH \rightleftarrows$ smectite clay $(NH_4)^+ + NaOH$. Since, in the foregoing equilibrium reaction, one equivalent weight of ammonium ion replaces an equivalent weight of sodium, it is customary to measure cation exchange capacity (sometimes termed "base exchange capacity") in terms of milliequivalents per 100 g. of clay (meq/100 g.) The cation exchange capacity of clays can be measured in several ways, including by electrodialysis, by exchange with ammonium ion followed by titration or by a methylene blue procedure, all as fully set forth in Grimshaw, "The Chemistry and Physics of Clays", pp. 264–265, Interscience (1971), incorporated herein by reference.

The cation exchange capacity of a clay mineral relates to such factors as the expandable properties of the clay, the charge of the clay, which, in turn, is determined at least in part by the lattice structure, and the like. The ion exchange capacity of clays varies widely in the range from about 3 meq/100 g. of kaolinites to about 150 me1/100 g., and greater, for certain smectite clays. Illite clays, although having a three layer structure, are of a nonexpanding lattice type and have an ion exchange capacity somewhere in the lower portion of the range, i.e., around 26 meq/100 g. for an average illite clay. Attapulgites, another class of clay minerals, have a spicular (i.e. needle-like) crystalline form with a low cation exchange capacity (25–30 meq/100 g.). Their structure is composed of chains of silica tetrahedrons linked together by octahedral grous of oxygens and hydroxyl containing Al and Mg atoms.

It has been determined that illite, attapulgite, and kaolinite clays, with their relatively low iion exchange capacities, are not useful in the instant compositions. Indeed, illite and kaolinite clays constitute a major component of clay soils which are removed from fabric surfaces by means of the instant compositions. However, the alkali metal montmorillonites, saponites, and hectorites, and certain alkaline earth metal varieties of these minerals such as calcium montmorillonites have been found to show useful fabric-softening benefits when incorporated in compositions in accordance with the present invention. Specific examples of such fabric-softening smectite clay minerals are: sodium montmorillonite, sodium hectorite, sodium saponite, calcium montmorillonite, and lithium hectorite. Accordingly, smectite clays useful herein can be characterized as montmorillonite, hectorite, and saponite clay minerals having an ion exchange capacity of at least about 50 meq/100 g., and preferably at least 60 meq/100 g.

The above discussion of optional clay additives is intended to only be a brief cursory review of the subject matter contained in U.S. Pat. No. 3,936,537, Baskerville et al, incorporated hereinabove by reference, and in U.S. Pat. No. 4,062,647, issued to Storm et al on Dec. 13, 1977, incorporated herein by reference.

The smectite clays are preferably admixed with the particulate detergent additive after the additive has been aged for a time sufficient for the complexing reaction to have been substantially completed.

Surfactant

The particulate detergent additive of the present invention can be further incorporated in a detergent composition, by, for example, dry mix addition, with a surfactant selected from the group consisting of anionic, nonionic, zwitterionic and ampholytic surfactants, and mixtures thereof. From about 5% to about 85% by weight, preferably from about 5% to about 50% by weight, and most preferably from about 10% to about 25% by weight of the final detergent composition can comprise the organic surfactnt component. Examples of organic surfactants useful herein have been described above as possible anionic complexing components, and are further described in U.S. Pat. No. 3,579,454, issued to E. J. Collier on May 18, 1971, incorporated herein by reference, from column 11, line 45 through column 13, line 64. An extensive discussion of surfactants is contained in U.S. Pat. No. 3,939,537, Baskerville et al, from column 11, line 39 through column 13, line 52, already incorporated hereinabove by reference.

Other Optional Ingredients

Other ingredients which are conventionally used in detergent compositions can be included in the detergent compositions of the present invention. These components include detergency builders, such as those enumerated in the Baskerville patent from column 13, line 54 through column 16, line 17, as well as color speckles, bleaching agents and bleach activators, suds boosters or suds suppressors, anti-tarnish and anti-corrosion agents, soil suspending agents, soil release agents, dyes, fillers, optical brighteners, germicides, pH adjusting agents, alkalinity sources, hydrotropes, enzymes, enzyme-stabilizing agents, perfumes, alkyl polyethoxylate nonionic surfactants, and other optional detergent compounds.

The detergent compositions of the instant invention can contain a detergency builder in an amount from about 5% to about 85% by weight, preferably from about 15% to about 60% by weight, and most preferably from about 20% to about 40% by weight of the entire detergent composition.

Method of Preparation

Initially, a solution containing from about 1% to about 80% by weight, preferably from about 5% to about 50% by weight of an anionic complexing component is prepared. Preferably, the anionic complexing component is present in solution at a concentration close to its saturation point. Overall, the anionic complexing component represents from about 0.01% to about 80% by weight, preferably from about 1% to about 70% by weight, most preferably from about 10% to about 60% by weight of the particulate detergent additive. The anionic complexing component is selected from the group consisting of nonsurfactant electrolytes, anionic synthetic surfactants, soaps, and mixtures thereof. In a preferred embodiment, water alone is the solvent of the complexing solution. The solution is sprayed onto the quaternary ammonium compound, resulting in the formation of a relatively insoluble complex which at least partially constitutes the surfaces of the antistatic material particles. The insoluble complex should constitute at least 10% of said surfaces, preferably constitutes at least 25% of said surfaces, more preferably constitutes at least 50% of said surfaces, and most preferably, the reaction produces an insoluble complex constituting substantially all the surfaces of the antistatic material particles. The reaction can also result in the complexation of substantially all of the quaternary ammonium compound. The anionic complexing component can optionally be admixed as a solid with the quaternary ammonium compound prior to being complexed, preferably by being sprayed with a complexing medium, preferably water or, with further improvement, a solution of anionic complexing component in water.

In a preferred embodiment of the present invention, the quaternary ammonium antistatic compound is intimately mixed with an organic dispersion inhibitor and formed into particulates, or prills, according to methods more fully described in the copending application of McDonald, Ser. No. 816,761, filed on July 18, 1977, now U.S. Pat. Ser. No. 4,141,841, issued Feb. 27, 1979, incorporated herein by reference. As another preferred embodiment, a water-soluble neutral or alkaline salt, preferably sodium tripolyphosphate, is admixed with the prills prior to the spray-on of either water alone or an anionic complexing solution. This procedure can also result in the formation of stable agglomerates consisting of the anionic complexing component and the prilled particles. The agglomerates are substantially free of organic agglomerating agents and, preferably, water alone acts as the agglomerating agent.

Smectite clay is optionally admixed or agglomerated into the additive product to provide an additional fabric-softening benefit.

The complexing medium can be sprayed onto the quaternary ammonium antistatic compound particles, prills, agglomerates, and other complexing components, in a mixer, such as the Schugi mixer (Flexomix 160, 250, 335 or 400), the O'Brien mixer, the Littleford mixer, the Patterson-Kelly mixer, ribbon mixers, a fluidized bed, and/or virtually any of the conventionally-known pan agglomerators. The optional smectite clays can be admixed with the additive product in a conventional pan agglomerator. The resulting particulate detergent additive composition is aged for approximately one hour, optionally mixed with silica if increased flowability is desired, and admixed with conventional detergent granules.

As used herein, all percentages given are "by weight", unless otherwise specified.

The following nonlimiting examples illustrate the additives and compositions of the present invention. As discussed hereinafter in the examples, the words "comparable results" and "substantially similar results" are intended to indicate that static control benefits can also be obtained at reduced antistatic agent levels.

EXAMPLE I

A particulate detergent additive composition is prepared as follows:

| Ingredient | Wt. % |
|---|---|
| Dimethyl di-hydrogenated tallow ammonium chloride (95% active powder) | 75 |
| Tallow alcohol | 25 |
| | 100 |

The dimethyl di-hydrogenated tallow ammonium chloride (DTDMAC) and tallow alcohol were melted together to form a clear solution at 250° F. This molten solution was atomized at 1600 psi into a chamber with ambient temperature air passing through the chamber. The atomized droplets froze into solid particles in the size range of about 20 microns to about 150 microns. The softening point of the DTDMAC/tallow alcohol mixture was about 165° F. The DTDMAC/tallow alcohol mixture had a solubility of substantially less than 10 ppm in 25° C. water. The prills in all the subsequent examples have essentially the same characteristics.

Sodium tripolyphosphate (STP) and the DTDMAC/tallow alcohol prills, in a 7:4 ratio of prill:STP were fed into a Schugi mixer (Flexomix 160) where they were thoroughly admixed. The sodium tripolyphosphate was a dry, anhydrous, powder with at least 90% passing through a 100-mesh Tyler sieve. The 7:4 ratio prill:STP mixture was sprayed with an anionic complexing solution comprising 0.7 parts sodium citrate, per 1 part water.

The reaction of the anionic complexing components (the sodium citrate and the STP) with the DTDMAC in the prills resulted in the formation of a relatively insoluble complex which constituted substantially all of the surfaces of the prills. This product was the particulate detergent additive of this Example.

The particulate detergent additive product was discharged from the Schugi Flexomix 160 mixer onto a pan agglomerator and there mixed with sodium montmorillonite clay of good fabric softening performance and having an ion exchange capacity of about 63 meq/100 g. (available from Georgia Kaolin Co. USA under the trade name Brock), which was also discharged onto the pan agglomerator. The resulting mix was aged for approximately one hour, mixed with silica to increase flowability, and then admixed, by dry mix addition, with a conventional detergent composition comprising surfactants, builders and other optional detergent ingredients.

The particulate detergent additive product provided increased static control performance and softening benefits relative to uncomplexed DTDMAC particles and to uncomplexed DTDMAC/tallow alcohol prills, either alone, when merely admixed with anionic complexing components or salts, or when agglomerated with anionic complexing components or salts, using conventional organic agglomerating agents.

Comparable results are obtained when the insoluble complex constitutes at least 10% of the surfaces of the DTDMAC particles or prills; and when the anionic complexing component complexes substantially all of the DTDMAC in the particles or prills.

Comparable results are obtained when the anionic complexing components, or mixtures thereof, are sprayed onto the DTDMAC particles or prills; when the complexing components are contacted in a fluidized bed reactor; and when the anionic complexing components, or mixtures thereof, are admixed as solids with the DTDMAC particles or prills and then sprayed with a complexing solution, which may comprise water and optionally other anionic complexing components.

Substantially similar results are obtained when the sodium citrate and/or the STP are replaced with other anionic complexing components, such as: sodium tetraborate, potassium tetraborate, sodium bicarbonate, potassium bicarbonate, sodium carbonate, potassium carbonate, potassium tripolyphosphate, sodium pyrophosphate, potassium pyrophosphate, sodium hexametaphosphate, potassium hexametaphosphate, sodium sulfate, potassium sulfate, potassium citrate, sodium acetate, potassium acetate, anionic surfactants such as $C_{10}$–$C_{13}$ linear and branched alkyl benzene sulfonates and $C_{10}$–$C_{13}$ alkyl ethoxylated ether sulfates containing one to four ethylene oxide groups, and mixtures thereof.

Substantially similar results are obtained when sodium tripolyphosphate is replaced with other water-soluble neutral or alkaline salts, such as: sodium tetraborate, potassium tetraborate, sodium bicarbonate, potassium bicarbonate, sodium carbonate, potassium carbonate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, and mixtures thereof.

Comparable results are obtained when the quaternary ammonium compound utilized is ditallow dimethyl ammonium methylsulfate, ditallow dimethyl ammonium ethylsulfate, 1-methyl-1-[(tallowamido)ethyl]-2-tallowimidazolinium methylsulfate, or mixtures thereof in place of the ditallow dimethyl ammonium chloride on a part for part basis.

Substantially similar results are obtained when the organic dispersion inhibitor is a mixture of $C_{10}$–$C_{22}$ alkyl sorbitan esters, the major components of which is one or more esters selected from the group consisting of sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof.

Comparable results are obtained when the organic dispersion inhibitor and/or the water-soluble neutral or alkaline salt are deleted from the system.

Comparable results are obtained when the clay is deleted from the system, or when other types of clay are substituted for sodium montmorillonite, such as sodium hectorite, sodium saponite, calcium montmorillonite, lithium hectorite, and mixtures thereof.

The silica is an optional additive, and substantially similar results are achieved without its inclusion.

Other types of mixers which are used in place of the Schugi Flexomix 160 are the Schugi Flexomix 250, 335, and 400, the O'Brien mixer, the Littleford mixer, the Patterson-Kelly mixer, ribbon mixers, and/or virtually any of the conventionally known pan agglomerators.

EXAMPLE II

The particulate detergent additive of Example I was incorporated into a detergent composition as follows:

| Base Detergent Granule | Parts |
|---|---|
| Sodium ($C_{12}$) linear alkylbenzene sulfonate | 12.0 |
| Sodium ($C_{14-15}$) alkyl polyethoxylate (1.1) sulfate | 6.0 |
| Sodium silicate (2.0 ratio) | 11.5 |
| Tallow fatty acid | 0.5 |
| Sodium tripolyphosphate | 16.8 |
| Sodium sulfate | 16.5 |
| Moisture | 5.3 |
| TOTAL base detergent granule | 68.6 |

| Admix | |
|---|---|
| Sodium montmorillonite clay (ion exchange capacity about 63 meq/100 g, commercially available from Georgia Kaolin Co., USA, under the trade name BROCK) | 10.4 |
| Sodium tripolyphosphate | 7.6 |
| Particulate detergent additive (complexed DTDMAC/tallow alcohol prills of Example I) | 6.9 |
| Miscellaneous (perfume, speckles, water and others) | 6.5 |
| TOTAL | 100.0 |

EXAMPLE III

The particulate detergent additive of Example I is incorporated into a detergent composition as follows:

| Base Detergent Granule | Parts |
|---|---|
| Sodium ($C_{12}$) linear alkyl benzene sulfonate | 12.0 |
| Sodium ($C_{14-15}$) alkyl polyethoxylate (1.1) sulfate | 6.0 |
| Sodium silicate (1.6 ratio) | 7.0 |
| Sodium aluminosilicate (hydrated zeolite A, particle diameter 1–10μ) | 20.0 |
| Sodium sulfate | 26.1 |
| Sodium citrate | 5.0 |
| Moisture | 4.8 |
| TOTAL base detergent granule | 80.9 |

| Admix | |
|---|---|
| Sodium montmorillonite clay (ion exchange capacity about 63 meq/100 g, commercially available from Georgia Kaolin Co., USA, under the trade name BROCK) | 9.0 |
| Particulate detergent additive (complexed DTDMAC/tallow alcohol prills of Example I) | 8.0 |
| Miscellaneous (perfume, speckles, water and others) | 2.1 |
| TOTAL | 100.00 |

The compositions of Examples II and III provide the static control advantages at reduced antistatic agent levels, as described in Example I.

EXAMPLE IV

A particulate detergent additive composition was prepared as follows:

The 7:4 ratio prills:STP mixture of Example I were fed into a Schugi mixer and sprayed with water. The water acted as an agglomerating agent and stable STP/prill agglomerates, the particulate detergent additive of this Example, were formed. The agglomerates were then discharged from the Schugi mixer onto a pan agglomerator and there admixed with sodium montmorillonite clay. The resulting mix was aged for approximately one hour, mixed with silica to increase flowability, and then admixed, by dry mix addition, with a conventional detergent composition comprising surfactants, builders and other optional ingredients.

The particulate detergent additive provided stable agglomerates and increased control performance and softening benefits relative to STP/prill agglomerates formed using conventional agglomerating agents, such as dextrin glues. Also, material costs were reduced and extra processing and handling steps were eliminated due to the elimination of conventional agglomerating agents.

Substantially similar results are obtained when the STP/prill mixture is agglomerated with solutions comprising water and being substantially free of organic agglomerating agents.

Substantially similar results are obtained when sodium tripolyphosphate is replaced with other water-soluble neutral or alkaline salts, such as: sodium tetraborate, potassium tetraborate, sodium bicarbonate, potassium bicarbonate, sodium carbonate, potassium carbonate, potassium tripolyphosphate, sodium pyrophosphate, potassium pyrophosphate, sodium hexamethaphoshate, potassium hexametaphosphate, sodium sulfate, potassium sulfate, sodium citrate, potassium citrate, and mixtures thereof.

Comparable results are obtained when the quaternary ammonium compound utilized is ditallow dimethyl ammonium methylsulfate, ditallow dimethyl ammonium ethylsulfate, 1-methyl-1-[(tallowamido)ethyl]-2-tallowimidazolinium methylsulfate, or mixtures thereof in place of the ditallow dimethyl ammonium chloride on a part for part basis.

Substantially similar results are obtained when the organic dispersion inhibitor is a mixture of $C_{10}$–$C_{22}$ alkyl sorbitan esters, the major components of which is one or more esters selected from the group consisting of sorbitan trilaurate, sorbitan trimyristate, sorbitan tripalmitate, sorbitan tristearate, sorbitan tetrlaurate, sorbitan tetramyristate, sorbitan tetrapalmitate, sorbitan tetrastearate, and mixtures thereof.

Comparable results are obtained when the clay is deleted from the system, or when other types of clay are substituted for sodium montmorillonite, such as sodium hectorite, sodium saponite, calcium montmorillonite, lithium hectorite, and mixtures thereof.

The silica is an optional additive, and substantially similar results are achieved without its inclusion.

Other types of mixers which are used in place of the Schugi Flexomix 160 are the Schugi Flexomix 250, 335, and 400, the O'Brien mixer, the Littleford mixer, the Patterson-Kelly mixer, ribbon mixers, and/or virtually any of the conventionally known pan agglomerators.

EXAMPLE V

A particulate detergent additive composition was prepared as follows:

A 7:8 part ratio prills (DTDMAC/tallow alcohol):STP mixture was agglomerated according to the procedure of Example IV, and admixed with sodium montmorillonite clay.

The composition of the admix was as follows:

| Admix | Parts |
|---|---|
| DTDMAC | 14.5 |
| STP | 33.4 |
| Water | 13.9 |
| Miscellaneous | 8.2 |
| Sodium montmorillonite clay | 30.0 |
| TOTAL | 100.0 |

The above-described mix was admixed on a 31 part basis, by dry mix addition, with the base detergent granule composition described in Example II. The detergent composition demonstrated the benefits described in Example IV.

EXAMPLE VI

A 7:4 ratio prill:STP mixture was prepared according to the procedure of Example I. The mixture was sprayed with an anionic complexing solution in a Schugi mixer. This procedure was repeated with other anionic complexing solutions being sprayed onto other samples of 7:4 prill:STP mixtures. As a control composition, a 7:4 prill:STP mixture was sprayed with a dextrinin-water organic agglomerating agent solution. The reaction of the anionic complexing components (the STP and the anionic component contained in the solution) with the DTDMAC in the prills resulted in the formation of a relatively insoluble complex which constituted at least 10% of the surfaces of the prills. Sodium montmorillonite clay was admixed with the complexed prills and/or the complexed prill agglomerates in a pan agglomerator. The resulting admix was incorporated into a conventional detergent composition, by dry mix addition, with the base detergent granules of Example II.

A series of fabrics were washed in these respective compositions, including the control composition, at a wash water temperature of about 100° F. and at a water hardness of about 2 grains per gallon, and then dried under ordinary machine drying conditions and at a dew point of about 40.5° F. Theese were full-scale washer and dryer loads using conventional fabric bundles. The fabrics were then measured for average volts per square yard using a Faraday cage apparatus and for number of clings.

The results of these tests, under ordinary wash water and machine drying conditions, demonstrated that the complexed prills and/or the complexed prill agglomerates formed by spraying certain anionic complexing solutions onto the prill/ST mixture delivered superior static control benefits to the fabrics at reduced antistatic agent levels relative to the control composition formed by spraying a dextrin-in-water solution onto the prill/STP mixture.

The admix compositions and the percent usage of the admix in the final detergent compositions were as follows:

| Sample | Composition | Parts |
|---|---|---|
| 63A | (23.85% usage) Prill:STP mixture | |
| | DTDMAC | 20.96 |
| | Tallow alcohol | 7.76 |
| | STP | 16.43 |
| | Complexing solution | |
| | Sodium sulfate | 0.97 |
| | Water | 8.69 |
| | Clay | 45.17 |

| Sample | Composition | Parts |
|---|---|---|
| 63B | (23.95% usage) Prill:STP mixture | |
| | DTDMAC | 20.88 |
| | Tallow alcohol | 7.76 |
| | STP | 16.36 |
| | Complexing solution | |
| | Sodium carbonate | 1.00 |
| | Water | 9.00 |
| | Clay | 45.00 |

| Sample | Composition | Parts |
|---|---|---|
| 71B | (26.11% usage) Prill:STP Mixture | |
| | DTDMAC | 19.15 |
| | Tallow alcohol | 7.11 |
| | STP | 15.01 |
| | Complexing solution | |
| | Sodium citrate | 7.59 |

-continued

| Sample | Composition | Parts |
|---|---|---|
| | Water | 10.84 |
| | Clay | 40.31 |

| Sample | Composition | Parts |
|---|---|---|
| 72A | (22.90% usage) Prill:STP Mixture | |
| | DTDMAC | 21.83 |
| | Tallow alcohol | 8.11 |
| | STP | 17.11 |
| | Complexing solution | |
| | Sodium sulfate | 2.10 |
| | $C_{12}$ linear alkyl benzene sulfonate | 1.40 |
| | Water | 3.50 |
| | Clay | 45.95 |

| Sample | Composition | Parts |
|---|---|---|
| 73B | (26.39% usage) Prill:STP Mixture | |
| | DTDMAC | 18.95 |
| | Tallow alcohol | 7.04 |
| | STP | 14.85 |
| | Complexing solution | |
| | Sodium sulfate | 3.00 |
| | $C_{12}$ tallow alkyl sulfate | 4.73 |
| | Water | 9.89 |
| | Clay | 40.84 |

| Sample | Composition | Parts |
|---|---|---|
| 75A | (25.68% usage) Prill:STP Mixture | |
| | DTDMAC | 19.47 |
| | Tallow alcohol | 7.23 |
| | STP | 15.26 |
| | Complexing solution | |
| | STP (not all in soln.) | 5.59 |
| | Water | 11.19 |
| | Clay | 41.26 |

| Sample | Composition | Parts |
|---|---|---|
| 75B | (25.46% usage) Prill:STP Mixture | |
| | DTDMAC | 19.64 |
| | Tallow alcohol | 7.30 |
| | STP | 15.39 |
| | Complexing solution | |
| | Sodium acetate | 5.35 |
| | Water | 10.70 |
| | Clay | 41.62 |

| Sample | Composition | Parts |
|---|---|---|
| 75C | (25.33% usage) Prill:STP Mixture | |
| | DTDMAC | 19.74 |
| | Tallow alcohol | 7.34 |
| | STP | 15.47 |
| | Complexing solution | |
| | Sodium sulfate (not all in solution) | 5.20 |
| | Water | 10.40 |
| | Clay | 41.84 |

| Sample | Composition | Parts |
|---|---|---|
| | (25.50% usage) | |
| Control | Prill:STP Mixture | |
| | DTDMAC | 16.1 |
| | Tallow alcohol | 6.0 |
| | STP | 24.5 |
| | Agglomerating solution | |
| | Dextrin glue | 4.6 |
| | Water | 12.6 |
| | Clay | 33.4 |
| | Miscellaneous | 2.8 |
| | | 100.0 |

The results were as follows:

Static Control Test Data

| Sample | % DTDMAC | | Ave. $\epsilon$[v]/yd$^2$ | Std. Dev. | Ave. Clings | Std. Dev. |
|---|---|---|---|---|---|---|
| Control | 4.92 | (4 runs) | 2.3 | 0.3 | 2.5 | 1.0 |
| | 3.5 | (2 runs) | 6.6 | 0.6 | 7.0 | 0.0 |
| 63A | 3.5 | (2 runs) | 2.7 | 1.1 | 2.0 | 0.0 |
| | 2.5 | (2 runs) | 1.3 | 0.4 | 0.0 | 0.0 |
| | 1.5 | | 5.6 | | 5.0 | |
| 63B | 3.5 | | 2.8 | | 6.0 | |
| | 2.5 | (3 runs) | 2.3 | 0.9 | 3.3 | 2.9 |
| 71B | 4.2 | (2 runs) | 2.0 | 0.6 | 1.5 | 2.1 |
| | 2.5 | (2 runs) | 3.4 | 0.3 | 3.0 | 1.4 |
| 72A | 3.5 | (3 runs) | 2.2 | 1.6 | 1.0 | 1.7 |
| | 2.5 | (3 runs) | 2.5 | 1.6 | 2.0 | 2.0 |
| | 1.5 | (5 runs) | 4.3 | 2.3 | 3.2 | 2.3 |
| 73B | 3.5 | | 2.1 | | 2.0 | |
| | 2.5 | | 2.2 | | 4.0 | |
| 75A | 3.5 | | 2.8 | | 4.0 | |
| | 2.5 | (2 runs) | 2.8 | 2.0 | 2.0 | 2.8 |
| 75B | 3.5 | | 2.3 | | 2.0 | |
| | 2.5 | (2 runs) | 2.2 | 1.1 | 1.5 | 2.1 |
| 75C | 3.5 | | 3.9 | | 3.0 | |
| | 2.5 | (3 runs) | 2.0 | 0.6 | 1.0 | 1.7 |
| | 1.5 | (5 runs) | 6.6 | 1.4 | 7.2 | 1.8 |

What is claimed is:

1. A particulate detergent additive for preventing static buildup on textiles and softening fabrics when applied thereto from a laundry solution, said particulate additive being substantially free of organic agglomerating agents, consisting essentially of an agglomerate of:

(a) from about 5% to about 75% by weight of a water-soluble neutral or alkaline salt, (b) from about 5% to about 75% by weight of an intimate mixture of (i) from about 99.9% to about 20% by weight of a quaternary ammonium compound of formula $[R_1R_2R_3R_4N]^+Y^-$ wherein at least one, but not more than two, of $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y constituting an anionic radical selected from the group consisting of hydroxide, halide, sulfate, methylsulfate, ethylsulfate and phosphate ions, and (ii) from about 0.1% to about 80% by weight of a dispersion inhibitor, being a solid organic material having a solubility in water of 50 ppm maximum at 25° C. and a softening point in the range of 75° F. to 250° F., said material being selected from the group consisting of paraffinic waxes, cyclic and acylic mono- and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof, and (c) from about 5% to about 75% by weight of water, substantially all of the additive particles having a size of about 10$\mu$ to about 500$\mu$, a solubility in water of about 50 ppm maximum at 25° C., and a softening point of from about 75° F. to about 250° F.

2. The particulate detergent additive of claim 1 wherein substantially all the additive particles are from about 25$\mu$ to about 250$\mu$ in size.

3. The particulate detergent additive of claim 2 wherein substantially all the additive particles are from about 50$\mu$ to about 100$\mu$ in size.

4. The particulate detergent additive of claim 1 wherein the additive particles have a softening point of from about 100° F. to about 200° F.

5. The particulate detergent additive of claim 4 wherein the additive particles have a softening point of about 150° F. to about 175° F.

6. The particulate detergent additive of claim 1 comprising from about 5% to about 40% by weight of said water-soluble neutral or alkaline salt.

7. The particulate detergent additive of claim 6 comprising from about 10% to about 30% by weight of said water-soluble neutral or alkaline salt.

8. The particulate detergent additive of claim 7 comprising from about 10% to about 20% by weight of said water-soluble neutral or alkaline salt.

9. The particulate detergent additive of claim 1 comprising from about 10% to about 60% by weight of said intimate mixture.

10. The particulate detergent additive of claim 9 comprising from about 30% to about 50% by weight of said intimate mixture.

11. The particulate detergent additive of claim 1 comprising from about 10% to about 50% by weight of water.

12. The particulate detergent additive of claim 11 comprising from about 20% to about 40% by weight of water.

13. The particulate detergent additive of claim 1 wherein the water-soluble neutral or alkaline salt is selected from the group consisting of alkali metal carbonates, alkali metal tetraborates, alkali metal orthophosphates, alkali metal polyphosphates, alkali metal bicarbonates, alkali metal silicates, alkali metal sulfates, alkali metal citrates, alkali metal acetates, and mixtures thereof.

14. The particulate detergent additive of claim 13 wherein the water-soluble neutral or alkaline salt is selected from the group consisting of sodium tetraborate, potassium tetraborate, sodium bicarbonate, potassium bicarbonate, sodium carbonate, potassium carbonate, sodium tripolyphosphate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, sodium acetate, potassium acetate, and mixtures thereof.

15. The particulate detergent additive of claim 14 wherein the water-soluble or alkaline salt is selected from the group consisting of sodium tripolyphosphate, sodium citrate, sodium sulfate, and mixtures thereof.

16. The particulate detergent additive of claim 15 wherein the water-soluble neutral or alkaline salt is sodium tripolyphosphate.

17. The particulate detergent additive of claim 13 wherein the quaternary ammonium compound is selected from the group consisting of ditallow dimethyl ammonium chloride, ditallow dimethyl ammonium methylsulfate, ditallow dimethyl ammonium ethylsulfate, 1-methyl-1-[(tallowamido)ethyl]-2-tallowimidazolinium methylsulfate, and mixtures thereof.

18. The particulate detergent additive of claim 17 wherein the dispersion inhibitor is selected from the group consisting of $C_{10}$–$C_{22}$ acyl sorbitan esters, tallow alcohol, and mixtures thereof.

19. The particulate detergent additive of claim 18 wherein the dispersion inhibitor is a mixture of $C_{10}$–$C_{22}$ acyl sorbitan esters, the major components of which is one or more esters selected from the group consisting of sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof.

20. The particulate detergent additive of claim 19 wherein the quaternary ammonium compound is ditallow dimethyl ammonium chloride.

21. The particulate detergent additive of claim 20 wherein the dispersion inhibitor is tallow alcohol.

22. The particulate detergent additive of claim 1 wherein the quaternary ammonium compound represents from about 90% to about 20% by weight of the intimate mixture (b).

23. The particulate detergent additive of claim 22 wherein the quaternary ammonium compound represents from about 80% to about 50% by weight of the intimate mixture (b).

24. The particulate detergent additive of claims 18 or 23 wherein the quaternary ammonium compound represents from about 75% to about 50% by weight of the intimate mixture (b).

25. A fabric softening/static control composition comprising the particlate detergent additive of claim 1 admixed with about 5% to about 70% by weight of smectite clay having an ion exchange capacity of at least 50 meq/100 g.

26. The composition of claim 25 comprising from about 25% to about 50% by weight of smectite clay having an ion exchange capacity of at least 60 meq/100 g.

27. A detergent composition for preventing static buildup on textiles and softening fabrics laundered therewith, comprising:

(1) from about 5% to about 85% by weight of surfactant selected from the group consisting of anionic, nonionic, ampholytic, and zwitterionic surfactants, and mixtures thereof, (2) from about 5% to about 85% by weight of detergency builder, (3) from about 10% to about 50% by weight of a particulate detergent additive being substantially free of organic aggomerating agents, consisting essentially of an agglomerate of:

(a) from about 5% to about 75% by weight of a water-soluble neutral or alkaline salt, (b) from about 5% to about 75% by weight of particles being an intimate mixture of (i) from about 99.9% to about 20% by weight of a quaternary ammonium compound of formula $[R_1R_2R_3R_4N]^+Y^-$ wherein at least one, but not more than two, of $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y constituting an anionic radical selected from the group consisting of hydroxide, halide, sulfate methylsulfate, ethylsulfate and phosphate ions, and (ii) from about 0.1% to about 80% by weight of a dispersion inhibitor, being a solid organic material having a solubility in water of 50 ppm maximum at 25° C. and a softening point in the range of 75° F. to 250° F., said material being selected from the group consisting of paraffinic waxes, cyclic and acyclic mono- and polyhydric alcohols, substituted and unsubstituted aliphatic carboxylic acids, esters of the foregoing alcohol and acids, $C_3$–$C_4$ alkylene oxide condensates of any of the foregoing materials and mixtures thereof, and (c) from about 5% to about 75% by weight of water, substantially all of the additive particles having a size of about 10μ to about 500μ, a solubility in water of about 50 ppm maximum at 25° C., and a softening point of from about 75° F. to about 250° F.

28. The composition of claim 27 comprising from about 10% to about 30% by weight of said water-soluble neutral or alkaline salt.

29. The composition of claim 27 comprising from about 30% to about 50% by weight of said intimate mixture.

30. The composition of claim 27 comprising from about 20% to about 40% by weight of water.

31. The composition of claim 27 wherein the water-soluble neutral or alkaline salt is selected from the group consisting of sodium tetraborate, potassium tetraborate, sodium bicarbonate, potassium bicarbonate, sodium carbonate, potassium carbonate, sodium tripolyphosphate, potassium tripolyphosphate, sodium pyrophosphate, potassium pyrophosphate, sodium hexametaphosphate, potassium hexametaphosphate, sodium sulfate, potassium sulfate, sodium citrate, potassium citrate, sodium acetate, potassium acetate, and mixtures thereof.

32. The composition of claim 31 wherein said water-soluble neutral or alkaline salt is selected from the group consisting of sodium tripolyphosphate, sodium citrate, sodium sulfate, and mixtures thereof.

33. The composition of claim 32 wherein the water-soluble neutral or alkaline salt is sodium tripolyphosphate.

34. The composition of claim 31 wherein said particulate detergent additive (3) comprises from about 10% to about 60% by weight of an intimate mixture of ditallow dimethyl ammonium chloride and tallow alcohol, the ditallow dimethyl ammonium chloride representing from about 80% to about 50% by weight of the intimate mixture.

35. The composition of claim 27 wherein said particulate detergent additive (3) is additionally admixed with from about 25% to about 50% by weight of sodium montmorillonite clay having an ion exchange capacity of at least 60 meq/100 g.

36. The composition of claim 27 which contains from about 5% to about 50% by weight of surfactant.

37. The composition of claim 36 which contains from about 10% to about 25% by weight of surfactant.

* * * * *